US010160127B2

(12) United States Patent
Dutta et al.

(10) Patent No.: US 10,160,127 B2
(45) Date of Patent: Dec. 25, 2018

(54) METHOD OF MANUFACTURING OF CUTTING KNIVES USING DIRECT METAL DEPOSITION

(71) Applicants: Bhaskar Dutta, Troy, MI (US); Harshad Natu, Mumbai (IN); W. Swenson, Bloomfield Hills, MI (US); Jyoti Mazumder, Ann Arbor, MI (US)

(72) Inventors: Bhaskar Dutta, Troy, MI (US); Harshad Natu, Mumbai (IN); W. Swenson, Bloomfield Hills, MI (US); Jyoti Mazumder, Ann Arbor, MI (US)

(73) Assignee: DM3D Technology, LLC, Troy, MI (US)

( * ) Notice: Subject to any disclaimer, the term of this patent is extended or adjusted under 35 U.S.C. 154(b) by 182 days.

(21) Appl. No.: 13/949,755

(22) Filed: Jul. 24, 2013

(65) Prior Publication Data

US 2014/0026730 A1 Jan. 30, 2014

Related U.S. Application Data

(62) Division of application No. 12/732,794, filed on Mar. 26, 2010.

(60) Provisional application No. 61/163,591, filed on Mar. 26, 2009.

(51) Int. Cl.

| | |
|---|---|
| ***B26D 1/00*** | (2006.01) |
| ***B26B 9/00*** | (2006.01) |
| ***C23C 24/10*** | (2006.01) |

(52) U.S. Cl.

CPC ..... *B26D 1/0006* (2013.01); *B26B 9/00* (2013.01); *C23C 24/106* (2013.01); *Y10T 83/929* (2015.04)

(58) Field of Classification Search

CPC .. B23H 9/00; B26B 9/00; B21K 11/02; B26D 1/0006; C23C 24/106; Y10T 83/929

See application file for complete search history.

(56) References Cited

U.S. PATENT DOCUMENTS

| | | | | |
|---|---|---|---|---|
| 3,990,329 A | | 11/1976 | Laurin | |
| 4,122,603 A | | 10/1978 | Sastri | |
| 4,299,860 A | * | 11/1981 | Schaefer | B23K 35/327 148/525 |
| 4,428,260 A | | 1/1984 | Eby | |
| 4,896,424 A | | 1/1990 | Walker | |

(Continued)

FOREIGN PATENT DOCUMENTS

SU 1191192 A * 11/1985

*Primary Examiner* — Stephen Choi

(74) *Attorney, Agent, or Firm* — Warner Norcross + Judd LLP

(57) ABSTRACT

Direct metal deposition (DMD) is used to fabricate knife edges with extended service life. A metal alloy powder is deposited along a blank and melted with a laser beam so that the powder solidifies into a strip of material having a hardness and/or wear resistance greater than that of the starting material. The piece is then finished to produce a sharp edge in the solidified material. The powder may be melted while it is being deposited, or it may be melted after being deposited. A slot or groove may be formed in the blank with the metal alloy powder being deposited into the slot or groove. A hardened steel alloy powder is deposited onto a mild steel blank. For example, a tool steel or vanadium steel powder may be deposited onto a 1018 steel blank. An invention line-beam nozzle may be used for deposition and/or powder melting.

22 Claims, 9 Drawing Sheets

(56) References Cited

U.S. PATENT DOCUMENTS

| | | | | |
|---|---|---|---|---|
| 4,945,640 | A | 8/1990 | Garg et al. | |
| 5,431,071 | A | 7/1995 | Williams | |
| 5,477,616 | A | 12/1995 | Williams et al. | |
| 5,842,387 | A | 12/1998 | Marcus et al. | |
| 6,109,138 | A | 8/2000 | Upton | |
| 6,316,065 | B1 | 11/2001 | Wallmann | |
| 6,422,110 | B1 | 7/2002 | Wurst et al. | |
| 6,534,745 | B1 * | 3/2003 | Lowney | B23K 26/1482 219/121.63 |
| 6,571,665 | B2 | 6/2003 | Julien | |
| 6,612,204 | B1 | 9/2003 | Droese et al. | |
| 6,701,627 | B2 | 3/2004 | Korb et al. | |
| 7,658,129 | B2 | 2/2010 | Korb et al. | |
| 2001/0046105 | A1 * | 11/2001 | Matsushita | G11B 5/102 360/234.3 |
| 2005/0038551 | A1 | 2/2005 | Mazumder et al. | |
| 2007/0137438 | A1 | 6/2007 | Zhu et al. | |
| 2007/0163128 | A1 | 7/2007 | Tarrerias | |
| 2007/0205184 | A1 | 9/2007 | Mazumder et al. | |
| 2007/0283786 | A1 | 12/2007 | Kappmeyer | |

* cited by examiner

METHOD OF MANUFACTURING OF CUTTING KNIVES USING DIRECT METAL DEPOSITION

REFERENCE TO RELATED APPLICATION

This application is a divisional of U.S. patent application Ser. No. 12/732,794, filed Mar. 26, 2010, which claims priority from U.S. Provisional Patent Application Ser. No. 61/163,591, filed Mar. 26, 2009, the entire content of both of which is incorporated herein by reference.

FIELD OF THE INVENTION

This invention related generally to cutting knives with hardened edges and, in particular, to knives, blades, shears, punches and other cutting or hole-forming implements wherein the hard edge material is fashioned with a direct-metal deposition (DMD) process as opposed to gluing, brazing or other bonding dissimilar materials.

BACKGROUND OF THE INVENTION

Cutting knives with durable sharp edges are needed in a wide variety of industries for cutting papers, coated papers, plastics, fibers, rubbers, card boards, films, foils, and biological tissues (i.e., in surgical applications). Conventional heat-treated edges presently in use have a limited life. Brazed carbide edges offer improved life, but failure at the brazed joint, and special requirements for sharpening carbide edges, makes them very expensive.

SUMMARY OF THE INVENTION

This invention broadly uses direct metal deposition (DMD) to fabricate knife edges with extended service life, while reducing the costs associated with sharpening and other post-processing requirements. The rapid solidification associated with DMD offers fine microstructure with improved micro-structure and mechanical properties. Knives produced in accordance with the invention exhibit superior edges, in some cases exceeding three times the life of comparable products available in the market.

A cutting knife fabricated in accordance with the invention begins with a metal blank or substrate. A metal alloy powder is deposited along the blank and melted with a laser beam so that the powder solidifies into a strip of material having a hardness and/or wear resistance greater than that of the starting material. The piece is then finished to produce a sharp edge in the solidified material.

The powder may be melted while it is being deposited, or it may be melted after being deposited. A slot or groove may be formed in the blank with the metal alloy powder being deposited into the slot or groove. In the preferred embodiments, a hardened steel alloy powder is deposited onto a mild steel blank. For example, a tool steel or vanadium steel powder may be deposited onto a 1018 steel blank. A combination of alloy powders may also be used, whether mixed or in layers.

A DMD system having a nozzle operative to deliver the powder on one or both sides of a line-shaped laser beam may be used in accordance with the invention, with the nozzle being moved along the blank to deposit and melt the powder. The line of the laser could be oriented substantially perpendicular to the strip. The finished edge may have a width sufficient to provide multiple sharpening. The finished sharp edge may be straight, serrated or curved.

DETAILED DESCRIPTION OF THE INVENTION

As an introduction, commonly assigned U.S. Pat. No. 6,122,564 describes a laser-aided, computer-controlled direct metal deposition (DMD) system wherein successive layers of material are applied to a substrate so as to fabricate an object or provide a cladding layer. The deposition tool path may be generated by a computer-aided manufacturing system, and feedback monitoring may be used to control the dimensions and overall geometry of the fabricated section in accordance with a computer-aided design description.

DMD systems are capable of depositing sections on metallic substrates of a differing material than used in the deposition, on the condition that suitable choices of material are made and suitable surface treatment is performed to achieve a good metallurgical bond between the deposited material and the underlying substrate.

This invention extends and improves upon the teachings set forth in the '564 Patent, the entire content of which is incorporated herein by reference. A method according to the invention is depicted in FIG. 1.

Figure 1A:
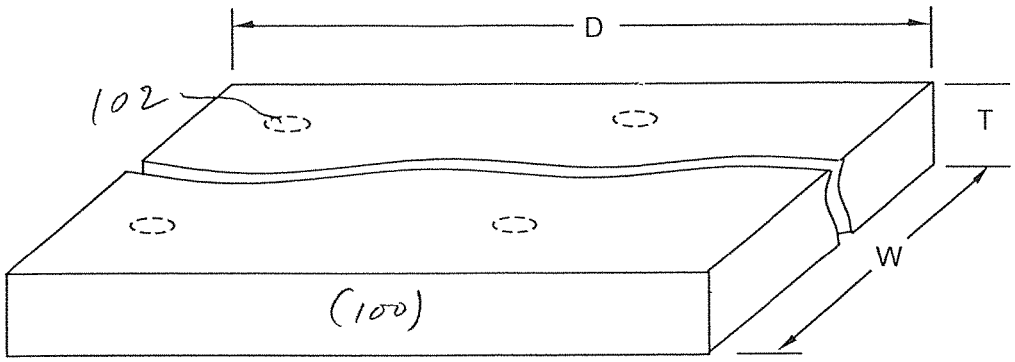
FIG. 1A is an oblique perspective of a blank of substrate material provided in accordance with the invention.

A blank 100 of metal such as mild steel is provided in FIG. 1A. The figure depicts a side view with the width being "W," the thickness being "T" and the depth being "D." The invention is not limited in terms of dimensions, in that cutters of less than a few millimeters and more than several feet may be fabricated, depending upon the end application. Holes 102 or other structures may be provided for mounting purposes.

Figure 1B:
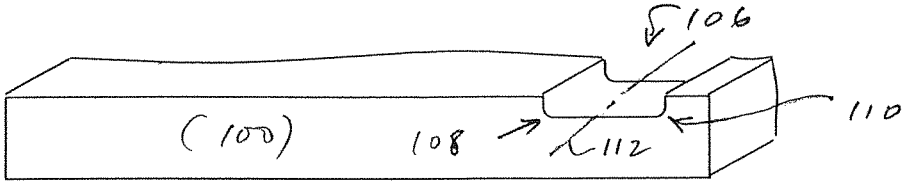
FIG. 1B shows a groove or slot formed in the blank.
Figure 1C:
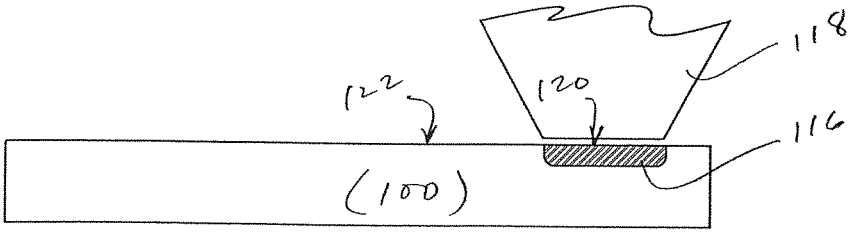
FIG. 1C shows the groove or slot being "filled" with harder material.
Figure 1D:
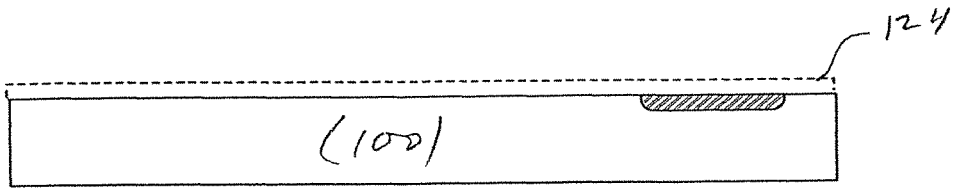
FIG. 1D shows a portion of a first surface of the composite structure being removed.
Figure 1E:
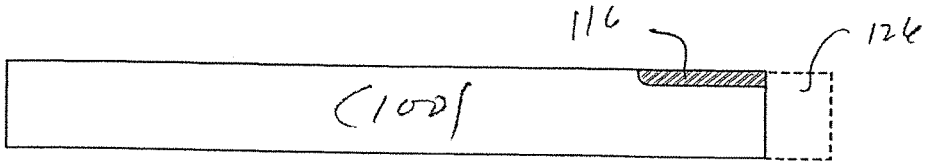
FIG. 1E shows a front section of the cutter being removed.
Figure 1F:
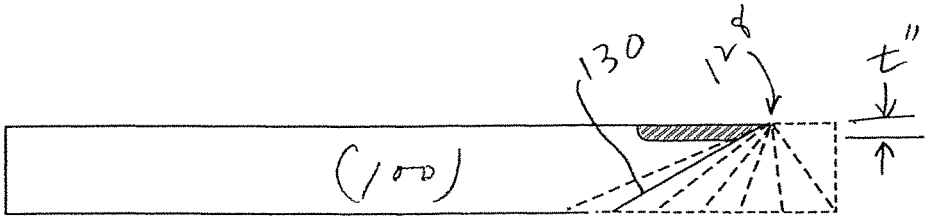
FIG. 1F illustrates various final angle cuts and polishes to produce a finished cutting knife.

FIG. 1B shows a groove 106 formed in the blank. The bottom of the groove may have rounded corners, as shown. In FIG. 1C, the groove is "filled" with hardened material 116 via direct-metal deposition using nozzle 118 described in further detail below. Although the upper surface 120 of the hardened material is depicted as flush with the top surface 122 of the blank 100 this is not absolutely necessary as the entire upper surface 124 is removed as shown in FIG. 1C. A portion of the top surface of the blank is removed to create a new top surface with the blank and solidified material being flush with one another prior to finishing as is best represent in FIG. 1D.

The forward portion 126 of the composite structure is also removed and a blade is formed through milling, grinding, cutting and/or polishing, thereby creating an edge 128 of hardened material 116 at an appropriate angle with surface such as 130. Since the angle is formed through known method the invention is not limited in this regard. For example, for paper cutting angles on the order of 15-35 degrees may be appropriate, though other surfaces are possible as depicted by the broken lines shown in FIG. 1F. In preferred embodiments, the final thickness of the blade "t" is sufficient to facilitate subsequent sharpening. Thicknesses of 0.02" or more should be appropriate.

Figure 2:
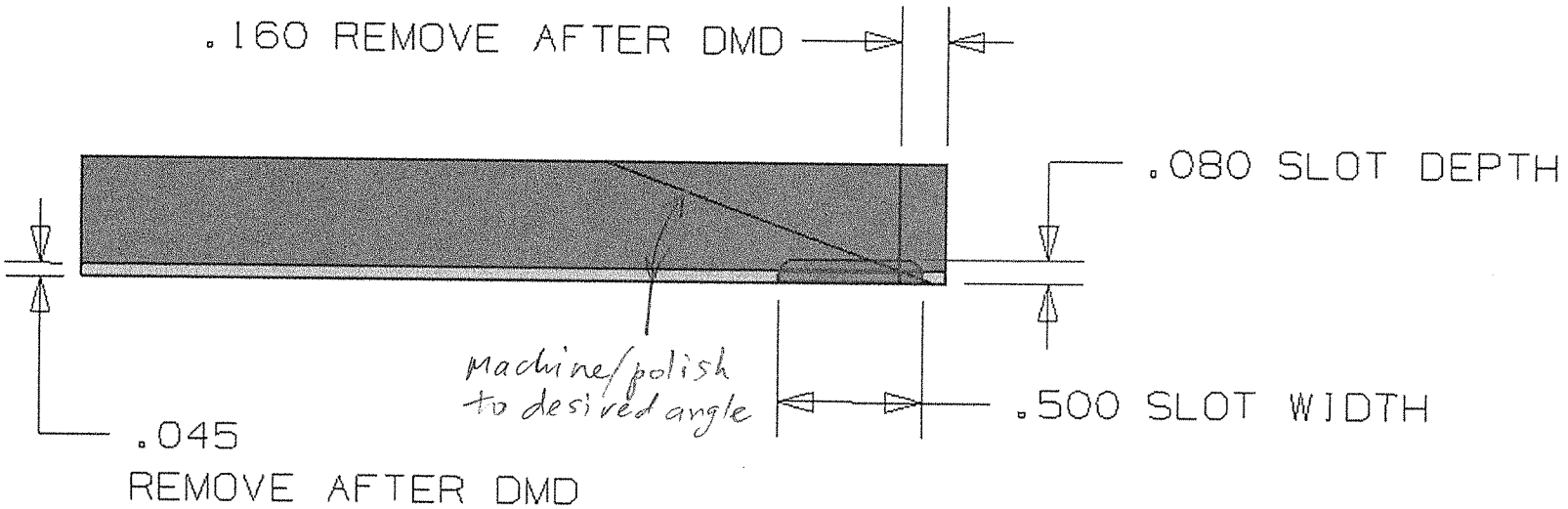
FIG. 2 is a cross-sectional view showing one preferred embodiment of the invention with dimensions shown.

Having described the general method, one detailed exemplary manufacturing process will now be detailed with reference to FIG. 2.

1) A long bar of mild steel (e.g., 1018 steel) is cut or formed into blanks having desired lengths or other dimensional parameters.

2) A slot of required size (e.g., 0.5" wide×0.08" deep) is machined into each blank. An appropriate radius may be used at the bottom of the groove. A groove location is identified from one long edge of the blank.

3) The machined blanks are placed in multi-blank (e.g., 4 blank) fixtures in a DMD machine, and hardened material is deposited into the milled slots.

4) Deposited blanks are inspected for visual defects, such as severe sink or pitting. Hardness is checked on random samples (RC 65-67).

5) A triple tempering of deposited blanks is performed at 1025° F. for 2 hours with air cooling between cycles. Again, hardness is checked on random samples (RC 65-67).

6) Blanks are machined to the following specifications:

a. Blanchard grind DMD side (knife face) to a Ra 20 micron finish
b. Blanchard grind side opposite to DMD (bevel face) to the required thickness and a Ra 20 micron finish
c. Blanchard grind from supposed knife edge to remove diluted material.
d. Blanchard grind opposite end of blank to the required height
e. Finish machine overall length to the required length
f. Drill and tap mounting holes
g. Machine 2 edge chamfers 0.030"
h. Machine 20 degree angle down to DMD material 7) Perform the following inspection operations: Measure thickness with micrometers and check overall length, width, angle of bevel, tapped hole size and location, and thickness of DMD material.

8) Carry out finish grinding—Grind face taper, Grind bevel face, Grind bevel angle. Inspect each knife during grinding operation.

9) Inspect random samples for dilution area by polishing and etching knife edge.

10) Perform final honing of knife edge.

11) Visually inspect honed edge of each knife, perform paper draw test on 1 of every three knives.

12) Chemically etch 1 knife per batch and record in logbook.

DEPOSITION TECHNIQUES

Two techniques may be used in accordance with the invention for depositing hard steels in the milled slots: the powder injection and powder pre-placement.

Powder injection technique

In this embodiment, the inventive, POM-designed line beam nozzle described below is used to inject tool steel powder in the melt pool created by a line laser beam in the milled slot.

Figures 3A, 3B, 3C:
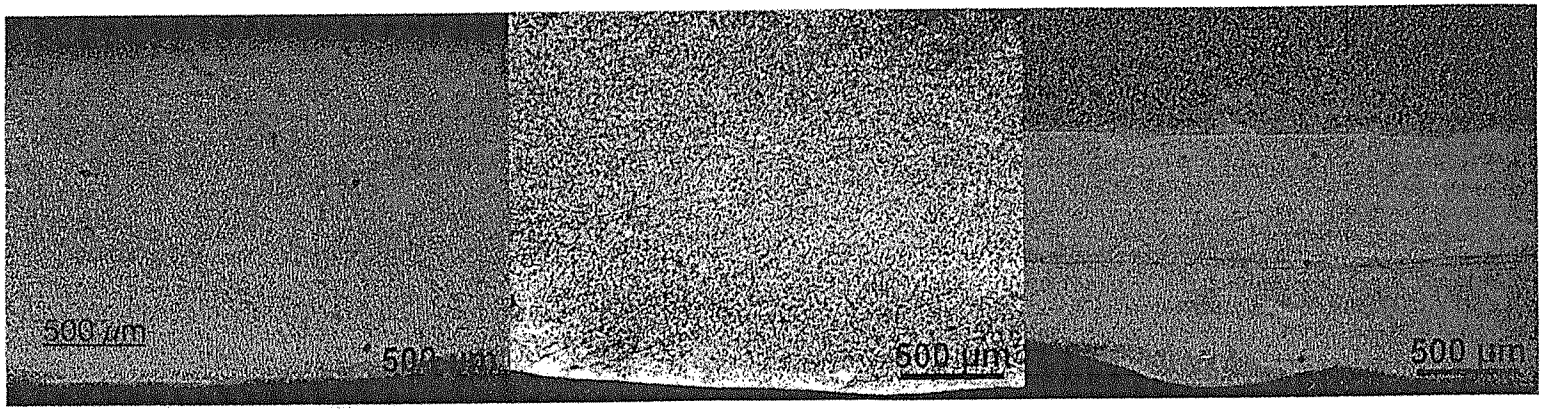
FIG. 3A is a macro structure of a deposition carried out using a line-beam powder injection nozzle according to the invention, in particular, the deposition being carried out with H13 tool steel.
FIG. 3B shows a line-beam powder injection technique having deposited V-tool steel (with vanadium in the range 1 to 10 percent weight)
FIG. 3C illustrates a deposition of a bi-layer deposit including H13 and vanadium steel utilizing the line-beam powder injection nozzle.
Figures 4A, 4B, 4C:
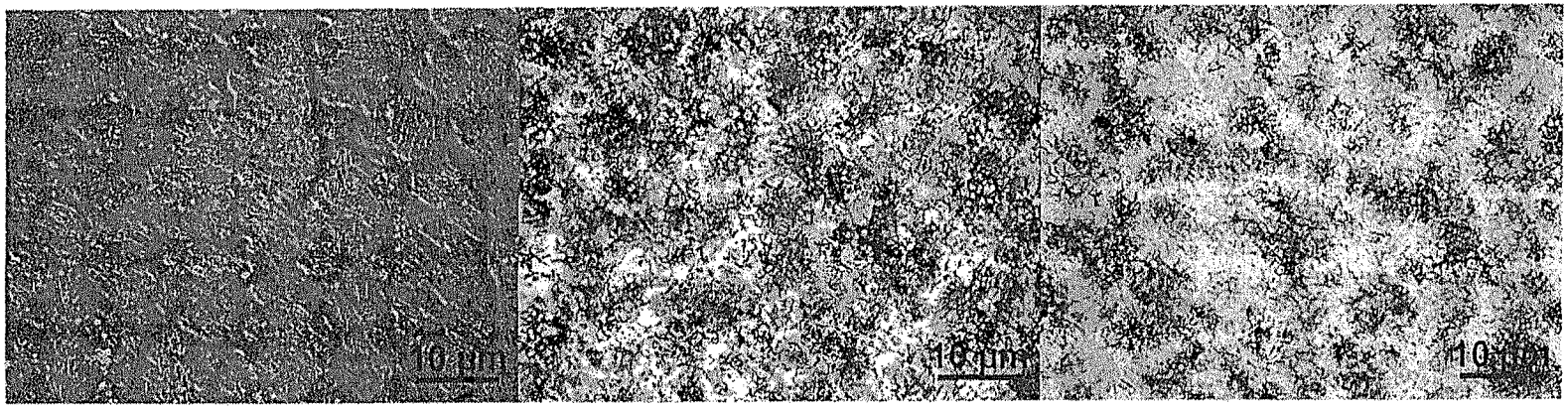
FIG. 4A is a macro structure of a deposition carried out using a line-beam powder injection nozzle according to the invention, in particular, the deposition being carried out with H13 tool steel.
FIG. 4B shows a line-beam powder injection technique having deposited V-tool steel (with vanadium in the range 1 to 10 percent weight)
FIG. 4C illustrates a deposition of a bi-layer deposit including H13 and vanadium steel utilizing the line-beam powder injection nozzle.

FIGS. 3A-3C shows macro-structures of depositions carried out using the line-beam powder injection nozzle. Deposition has been carried out with H13 tool steel, V-tool steel (with vanadium 1 to 10% weight percent) and then, a bi-layer deposition of H13 tool steel and V-tool steel with a 1018 steel substrate in all the cases. FIGS. 4A-4C show higher magnification micrographs of these samples. A dendritic structure is revealed in all the cases. A fine dispersion of carbides is also noted in the microstructures.

Powder pre-placement technique

In this case, tool steel powder is placed uniformly in the groove to fill the machined slot. A scan with a high-power laser (e.g., $CO_2$, Diode, Nd-Yag) is performed using appropriate settings. (e.g., P=3.5 kw; S=150 mm/min; Gases=25 lpm Nozzle Ar). The process parameters will depend on the geometry of the knife substrate and desired production volume and quality.

Figures 5A, 5B, 5C:
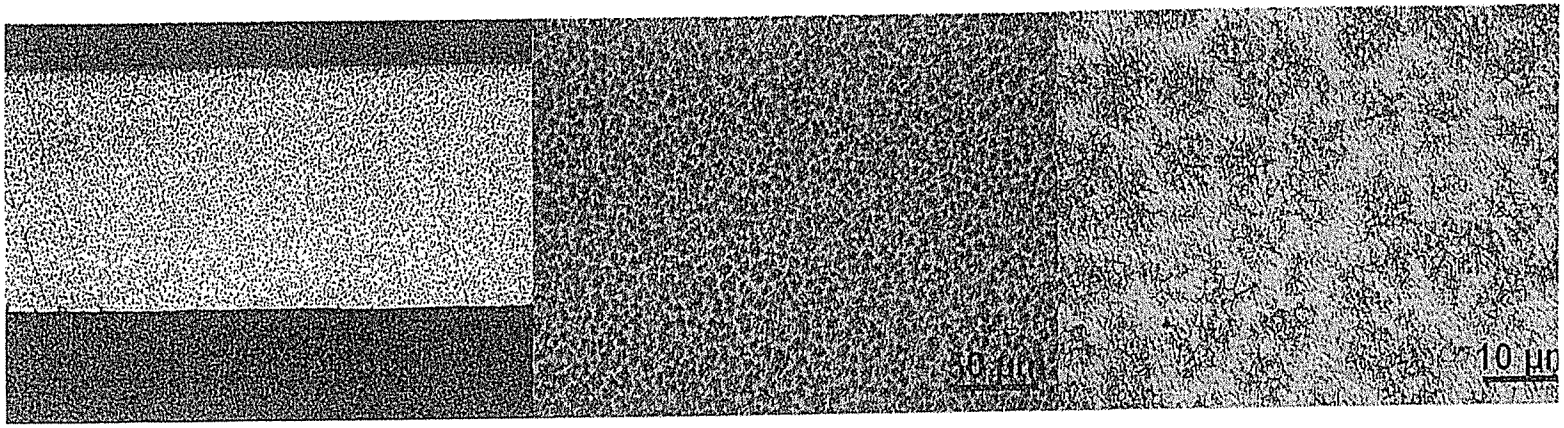
FIGS. 5A-5C show macro and micro structures of deposits with line-beam and alternative powder pre-placement. It is noted that the microstructure is coarser as compared to that in FIG. 4.

FIGS. 5A-5C shows macro and microstructures of deposits with line beam using the alternative powder pre-placement technique. It is to be noted that the microstructure is coarser as compared to that in the earlier figure, deposited with powder injection technique.

Figure 6:
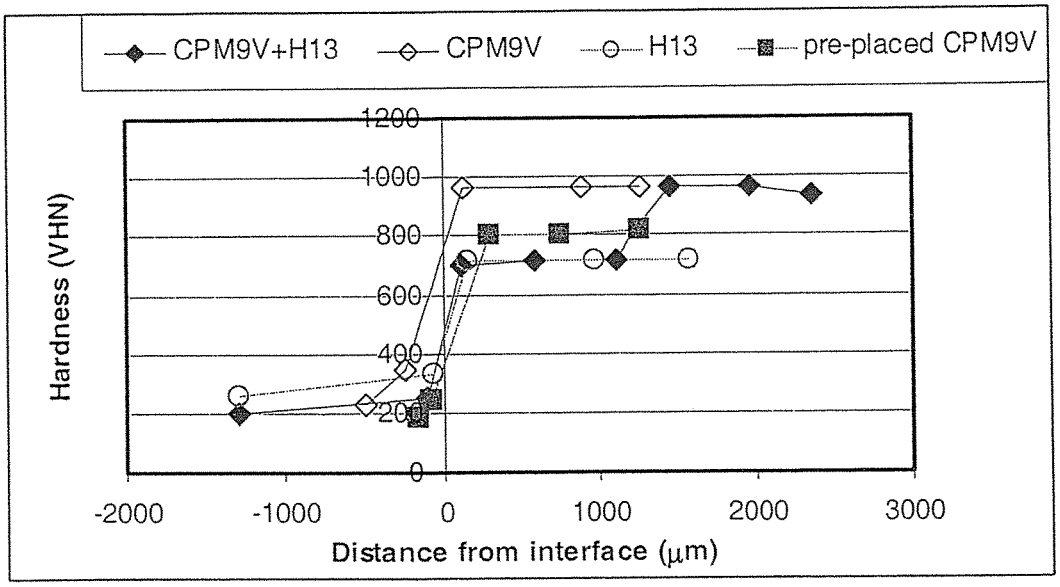
FIG. 6 is a graph plotting hardness variation across the deposits as a function of distance from the substrate/deposit interface.

FIG. 6 shows hardness variation with distance through deposit cross-section for the above-described cases. Clearly the hardness of V-based steel with powder pre-placement technique is lower than that of deposit from powder injection technique. The finer microstructure and higher hardness is a result of faster cooling in powder injection used in DMD as compared to powder pre-placement.

LINE-BEAM NOZZLE

As mentioned, a line-beam nozzle was designed and preferably used for deposition with powder injection. FIG.

Figure 7A:
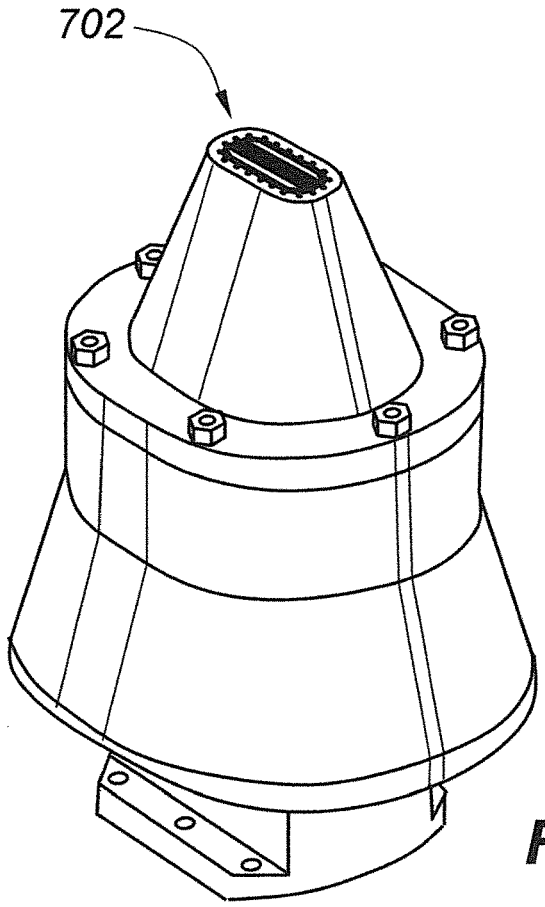
FIG. 7A is a perspective view of the nozzle, which in this case, is made of aluminum.
Figure 7B:
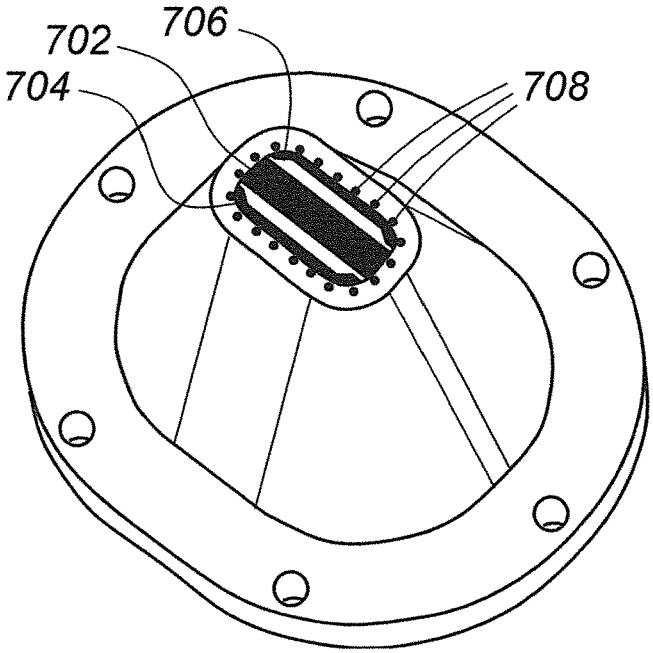
FIG. 7B is a close-up view of a nozzle showing the end thereof.

7A is a perspective view of the nozzle, which is made of aluminum. FIG. 7B is a close-up view showing the end of the nozzle. The nozzle includes a central slot 702 where the laser beam emerges, surrounded by two slots 704, 706 on either side for powder injection. A series of small holes (i.e., 708) on either side carry shaping gas to the melt pool. To improve performance, the nozzle was modified using copper inserts inside the nozzle. A cylindrical lens is used to shape the laser beam into a line.

Figure 8A:
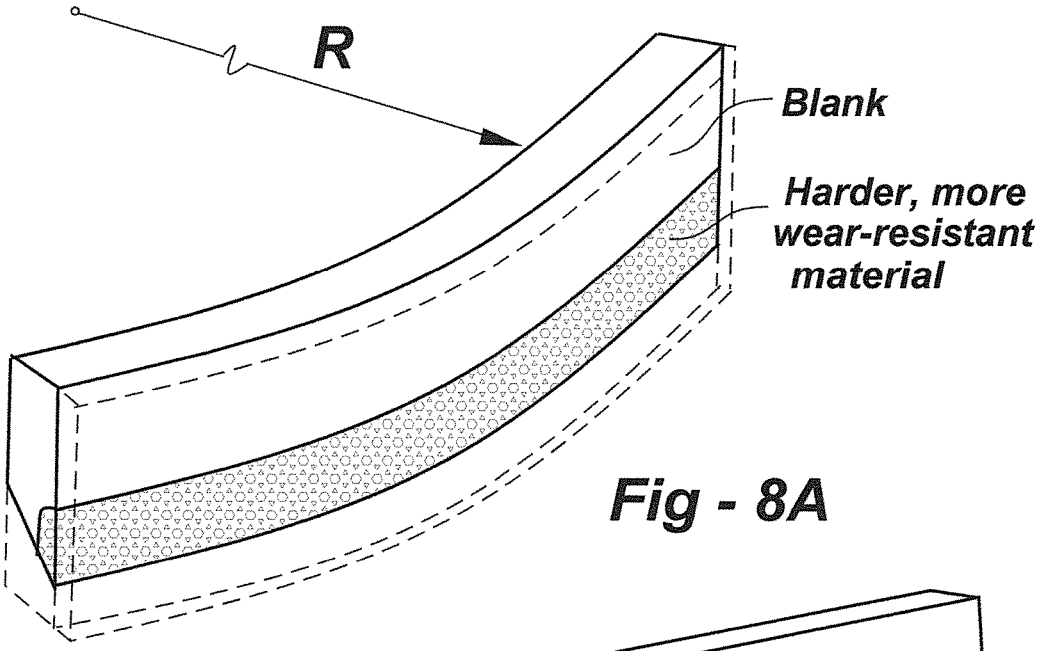
FIG. 8A illustrates a curved blade fabricated in accordance with the invention.
Figure 8B:
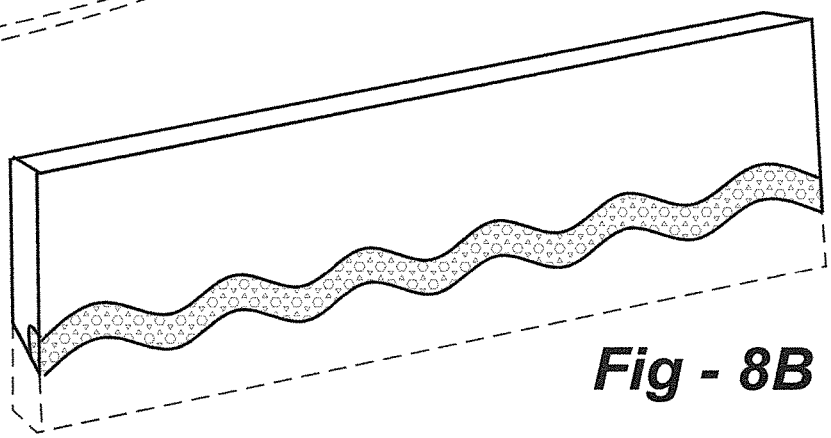
FIG. 8B illustrates a serrated blade fabricated in accordance with the invention.
Figure 8C:
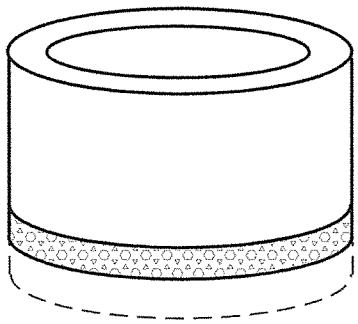
FIG. 8C illustrates a wear-resistant punch fabricated in accordance with the invention.

During use of the nozzle, the line of the laser is oriented substantially perpendicular to the axis of deposition (i.e., line 112 if FIG. 1B). The inventive line-beam nozzle is preferably used for both the powder injection and preplacement techniques described above; however, a conventional beam may be used in either case with reduced quality and/or throughput. In addition to straight blades the invention may be used to produce curved or serrated blades and punches having cylindrical or other shapes (FIGS. 8A-8C).

We claim:

1. A method of fabricating an improved cutting knife, comprising the steps of:

providing a metal blank of a first hardness, the blank having a top surface and a distal end;

forming a groove in the top surface of the blank, the groove defining a width and extending in a lengthwise direction;

providing a nozzle and a cylindrical lens to shape a laser beam into a line-shaped focus, the nozzle including a central slot for the laser beam and first and second elongated slots on opposing lateral sides of the central slot for discharging metal alloy powder;

orienting the line shaped focus of the laser beam widthwise to the groove and moving the line shaped focus in the lengthwise direction of the groove along an axis of deposition of the metal alloy powder for generating a melt pool inside the groove, wherein the melt pool is formed by depositing the metal alloy powder on opposing lateral sides of the line-shaped focus of the laser beam into the groove;

providing a shaping gas circumscribing the line shaped focus of the laser beam directed at the melt pool;

melting the powder with the line-shaped focus of the laser beam so that the powder solidifies into a strip of material having a second hardness greater than the first hardness; and finishing at least the solidified material to produce a sharp edge.

2. The method of claim 1, including the step of forming the groove widthwise in the blank and spaced away from the distal end.

3. The method of claim 1, including a step of removing the top surface of the blank to create a new top surface causing the blank and the solidified material to become flush with one another.

4. The method of claim 1., including a step of removing material from the distal end of the blank and a portion of the solidified material.

5. The method of claim 1, including the step of removing the solidified material at an acute angle relative to top surface of the blank.

6. The method of claim 1, wherein the step of depositing a metal alloy powder in the groove is further defined by melting the powder while it is being deposited.

7. The method of claim 1, wherein the step of depositing a metal alloy powder in the groove is further defined by melting the powder after being deposited.

8. The method of claim 1, including the steps of: providing a mild steel blank; and depositing and melting a hardened steel alloy powder.

9. The method of claim 1, including the steps of: providing a 1018 steel blank; and depositing and melting a tool steel or vanadium steel powder.

10. The method of claim 1, wherein said step of finishing at least the solidified material to produce a sharp edge is further defined by producing a serrated edge.

11. The method of claim 1, wherein said step of finishing at least the solidified material to produce a sharp edge is further defined by producing a curved edge.

12. A method of fabricating an improved cutting knife, comprising the steps of:

providing a metal blank with a first hardness, the blank having a top surface and a distal end;

forming a groove in the top surface of the blank and spaced away from the distal end, the groove defining a width and extending in a lengthwise direction;

providing a nozzle and a cylindrical lens to shape a laser beam into a line-shaped focus, the nozzle including a central slot for the laser beam and first and second elongated slots on opposing lateral sides of the central slot for discharging a metal alloy powder;

depositing the metal alloy powder in the groove while simultaneously generating the line-shaped focus of the laser beam and orienting the line-shaped focus of the laser beam widthwise to the groove while moving the line shaped focus of the laser beam in the lengthwise direction along an axis of deposition of the metal alloy powder along the groove with the metal alloy powder being directed toward opposite sides of the line shaped focus of the laser beam;

melting the powder with the laser beam so that the powder solidifies into a strip of material having a second hardness greater than the first hardness;

removing a portion of the top surface of the blank to create a new top surface wherein the blank and solidified material are flush with one another; and removing material from the distal end of the blank and a portion of the solidified material to produce a sharp edge in solidified material.

13. The method of claim 12, wherein the step of removing material from the distal end of the blank includes removing the solidified material at an acute angle relative to the new top surface.

14. The method of claim 12, wherein the step of depositing a metal alloy powder in the groove is further defined by melting the powder while it is being deposited.

15. The method of claim 12, wherein the step of depositing a metal alloy powder in the groove is further defined by melting the powder after being deposited.

16. The method of claim 12, including the steps of: providing a mild steel blank; and depositing and melting a hardened steel alloy powder.

17. The method of claim 12, including the steps of: providing a 1018 steel blank; and depositing and melting a tool steel or vanadium steel powder.

18. The method of claim 12, wherein the blade has a width sufficient to provide multiple sharpening.

19. The method of claim 12, including the step of providing a combination of alloy powders at the same time or in layers.

20. The method of claim 12, wherein said step of finishing at least the solidified material to produce a sharp edge is further defined by producing a straight edge.

21. The method of claim 12, wherein said step of finishing at least the solidified material to produce a sharp edge is further defined by producing a serrated edge.

22. The method of claim 12, wherein said step of finishing at least the solidified material to produce a sharp edge is further defined by producing a curved edge.

* * * * *